US008276990B2

(12) United States Patent
Klabisch et al.

(10) Patent No.: US 8,276,990 B2
(45) Date of Patent: Oct. 2, 2012

(54) DRIVE STATION FOR AN UNDERGROUND PLOUGH SYSTEM AND METHOD FOR REPAIRING RECOVERY PLOUGHS

(75) Inventors: Adam Klabisch, Dortmund (DE); Klaus Duhnke, Werne (DE); Norbert Hesse, Bochum (DE); Gerhard Siepenkort, Lünen (DE); Diedrich Bettermann, Unna (DE)

(73) Assignee: Caterpillar Global Mining Europe GmbH, Lünen (DE)

( * ) Notice: Subject to any disclaimer, the term of this patent is extended or adjusted under 35 U.S.C. 154(b) by 369 days.

(21) Appl. No.: 12/665,421

(22) PCT Filed: Jun. 20, 2008

(86) PCT No.: PCT/EP2008/005196

§ 371 (c)(1), (2), (4) Date: Dec. 18, 2009

(87) PCT Pub. No.: WO2009/003632

PCT Pub. Date: Jan. 8, 2009

(65) Prior Publication Data

US 2010/0320828 A1 Dec. 23, 2010

(30) Foreign Application Priority Data

Jul. 2, 2007 (DE) ..... 10 2007 030 646

(51) Int. Cl.
*E21C 29/14* (2006.01)

(52) U.S. Cl. ..... 299/34.07

(58) Field of Classification Search ..... 299/34.07
See application file for complete search history.

(56) References Cited

FOREIGN PATENT DOCUMENTS

| | | |
|---|---|---|
| DE | 1960710 | 5/1967 |
| DE | 7042204.7 | 2/1971 |
| DE | 3122890 A1 | 1/1983 |
| DE | 3923320 A1 | 1/1991 |
| DE | 4231252 A1 | 3/1994 |
| DE | 94 16 657.9 | 2/1995 |

OTHER PUBLICATIONS

Translation of G9416657.9 translation dated Feb. 16, 1012.*
International Search Report, dated Oct. 2, 2009, for PCT/EP2008/005196, Filed Jun. 20, 2008.

* cited by examiner

*Primary Examiner* — John Kreck
(74) *Attorney, Agent, or Firm* — Rankin, Hill & Clark LLP

(57) ABSTRACT

The invention relates to a drive station for an underground plough system, in particular a coal plough system, with a machine frame to which a plough box can be fastened, and with a wedge trough which is connected to the machine frame and is provided with a plough guide device, which has chain channels for a plough chain, and also a plough end stop on a runout section for a winning plough. In order to facilitate the repair of a winning plough, the plough end stop is formed on an attachment which can be dismantled, when the plough guide device is mounted, to produce a repair section in the longwall-gallery transition of the wedge trough. The invention also relates to a repair method in which the plough end stop is dismantled and the winning plough is moved into the repair section.

21 Claims, 2 Drawing Sheets

DRIVE STATION FOR AN UNDERGROUND PLOUGH SYSTEM AND METHOD FOR REPAIRING RECOVERY PLOUGHS

This application claims priority to and the benefit of the filing date of International Application No. PCT/EP2008/005196, filed Jun. 20, 2008, which application claims priority to and the benefit of the filing date of German Application No. 10 2007030646.8, filed Jul. 2, 2007, both of which are hereby incorporated by reference into the specification of this application.

The invention relates to a drive station for an underground plough system, in particular a coal plough system, with a machine frame to which a plough box can be fastened or is fastened for supporting a plough chain wheel for returning a plough chain, and with a wedge trough or connection trough which can be connected or is connected to the machine frame and is provided with a plough guide device, which has chain channels for a plough chain, and also a plough end stop on a runout section for a winning plough. The invention further relates to a method for carrying out repair work on a winning plough which can be moved in the underground longwall between two working stations of a plough system, the drive stations having a machine frame, to which a plough box is fastened for supporting and bearing a plough chain wheel for deflecting a plough chain, and also a wedge trough or connection trough which is connected to the machine frame and is provided with a plough guide device, which is arranged on a runout section for the winning plough, and also a plough end stop.

In chain-pulled winning ploughs for underground winning operations, the plough chain wheels, which serve to drive and to deflect the plough chain, are arranged in a plough box which is built laterally onto the machine frame of a drive station of a scraper chain conveyor. As the plough chain wheels have a relatively large diameter, at least one wedge trough or connection trough, which compensates for the height offset necessary for the scrapers along with the scraper chain, is arranged between the trough pans, which are provided with plough guide pans, of the plough system and the drive stations. A similar height offset also exists for the chain strands of the plough chain and this height offset is also compensated for over the length of the wedge trough. Reference is made, merely by way of example of the drive stations of plough systems, to DE 39 23 320 A1 which is incorporated by reference herein for showing the same.

As, depending on the winning plough used and the drive power required, different drive stations are installed in the underground plough systems, the connection troughs or wedge troughs are usually special designs which at the same time ensure, by way of suitable measures, that the winning plough can be brought up as close as possible to the drive stations arranged in the main or auxiliary section. In order to prevent damage to the drive stations, a plough end stop, which can for example be designed as an impact chock and which the winning plough may strike at the end of a runout section, is mounted in the region of the connection or wedge troughs. If repair work to the winning plough is necessary, efforts are made to bring the winning plough as close as possible to the connection or wedge trough in order to be able to carry out the repair work there, since miners have slightly more freedom of movement in the region of the connection troughs than within the longwall.

SUMMARY OF INVENTION

An object of the invention is to improve the design of drive stations for an underground plough system and also to facilitate carrying out of repair work on a winning plough.

In order to achieve this object and others, the invention proposes, in a drive station for a plough system, that the plough end stop be formed on or fastened to an attachment which can be dismantled, when the plough guide device is furthermore mounted, to produce a repair section in the longwall-gallery transition of the wedge trough or connection trough. The solution according to the invention allows, in particular for maintenance or repair work to the winning plough, the plough guide device to remain mounted on the wedge trough, enabling the winning plough to be brought up to the position of the plough end stop. However, the plough end stop, which is fastened to or formed on an attachment, is dismantlable, for which reason the winning plough can be moved further in the direction of the main or auxiliary section when the plough end stop is dismantled. Dismantling the plough end stop, which is formed on an attachment, therefore affords the possibility of obtaining a repair section which is situated, compared to the solutions known in the art, no longer in the longwall end region before the longwall-gallery transition, but rather offset into the longwall-gallery transition or even into the gallery.

The two drive stations of an underground plough system are normally positioned in such a way that the plough boxes, with the drive motors flanged thereon for the plough wheel chains, are situated in the region of the main section or auxiliary section, whereas the connection or wedge troughs are situated, at least in part, in the underground longwall in which the coal is mined and won. If, on the winning plough, repair work has to be carried out for example only on the sliding or guide shoes, it may be sufficient, for a repair to be carried out, to dismantle exclusively the attachment, as this alone makes at least one of the guide shoes relatively readily accessible.

In accordance with another aspect, the attachment has a base plate which can be fastened to the wedge trough or connection trough by means of hook-like interlocking elements. It is particularly advantageous if the wedge trough or connection trough has a holding plate with hook-like interlocking elements for arresting the attachment. The attachment can be mounted or dismantled particularly simply if, in accordance with a particularly preferred configuration, the upper, hook-like interlocking element consists of a dismantlable locking strip. The lower, hook-like interlocking element then does not need to be dismantled for dismantling the attachment, but can remain in its position or be formed integrally with the holding plate. The solution according to the invention with a dismantlable attachment allows, in particular, the plough guide device to consist of a plough guide pan which is securely mounted on the wedge trough. In contrast to the prior art, in which the plough guide devices were in any case in principle dismantlable in the region of the wedge trough, this is no longer required in the solution according to the invention.

According to yet another aspect, at least one, preferably a plurality of, projecting locking body/bodies is formed on the holding plate and recesses, which interact with the locking bodies, are formed on the base plate for form-fitting support of the attachment in the running direction of the winning plough. The locking bodies, which dip into the recesses, prevent relative movements between the wedge trough and the dismantlable plough end stop formed on the attachment when the attachment is mounted. It is particularly advantageous if the recesses in the base plate consist of vertically extending, open-edged slots allowing upward dismantling of the attachment. For vertical dismantling of the attachment, it is particularly advantageous if the upper, hook-like interlocking element consists, as described above, of a dismantlable locking strip. Also preferably, a chain fixing device, which can in particular be formed by a pivotable blocking pawl or consist thereof, can be fastened to the attachment. The provision of a chain fixing device in the dismantlable attachment allows further chain links to be inserted in a relatively simple manner into the plough chain when the attachment is mounted, if for example the length of the plough system is increased by inserting intermediate troughs or the tensioning path of a tensionable drive station is not sufficient for tensioning the plough or conveyor chain. Expediently, the attachment can have a chain channel cover which opposes the base plate, in parallel and at a distance, and can be dismantled at least in the region of the chain fixing device, in order to ensure that the plough chain is readily accessible in the region of the drive station for repair work.

Also preferably, a flange plate for the plough box with hook-like interlocking elements can also be formed on or fastened to the machine frame, the upper, hook-like interlocking element being, in turn, dismantlable and preferably consisting of a locking strip. In a corresponding configuration, both the attachment and the plough box are detachably fastened in a similar manner to the drive station and the wedge trough respectively. This easy dismantlability is particularly advantageous if a running rail is fastened to the wedge trough or the connection trough, when the attachment is dismantled, in order to lengthen the repair section as far as possible into the underground main or auxiliary section. By attaching a running rail instead of the attachment and/or additionally instead of the plough box, the winning plough can if appropriate be moved into the main or auxiliary section in order to be able to carry out there, in particular, relatively complex repair work.

According to yet further aspects of the invention, a method for carrying out repair work is provided, wherein, according to the invention, a repair section is formed in the longwall-gallery transition or in the gallery by dismantling the plough end stop and the winning plough is moved into this repair section for the repair. In the particularly preferred configuration, a running rail is fastened to the wedge trough or the connection trough for producing a repair section, when the plough end stop is dismantled, and also preferably when the plough box is additionally dismantled. It will be understood that the guide elements on the running rail are embodied and positioned in such a way that the winning plough can easily be moved between the plough guide devices in the region of the wedge trough or the trough pans and the running rail.

These and other objects, aspects, features, developments and advantages of the invention of this application will become apparent to those skilled in the art upon a reading of the Detailed Description of Embodiments set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DETAILED DESCRIPTION OF EMBODIMENTS

Figure 1:
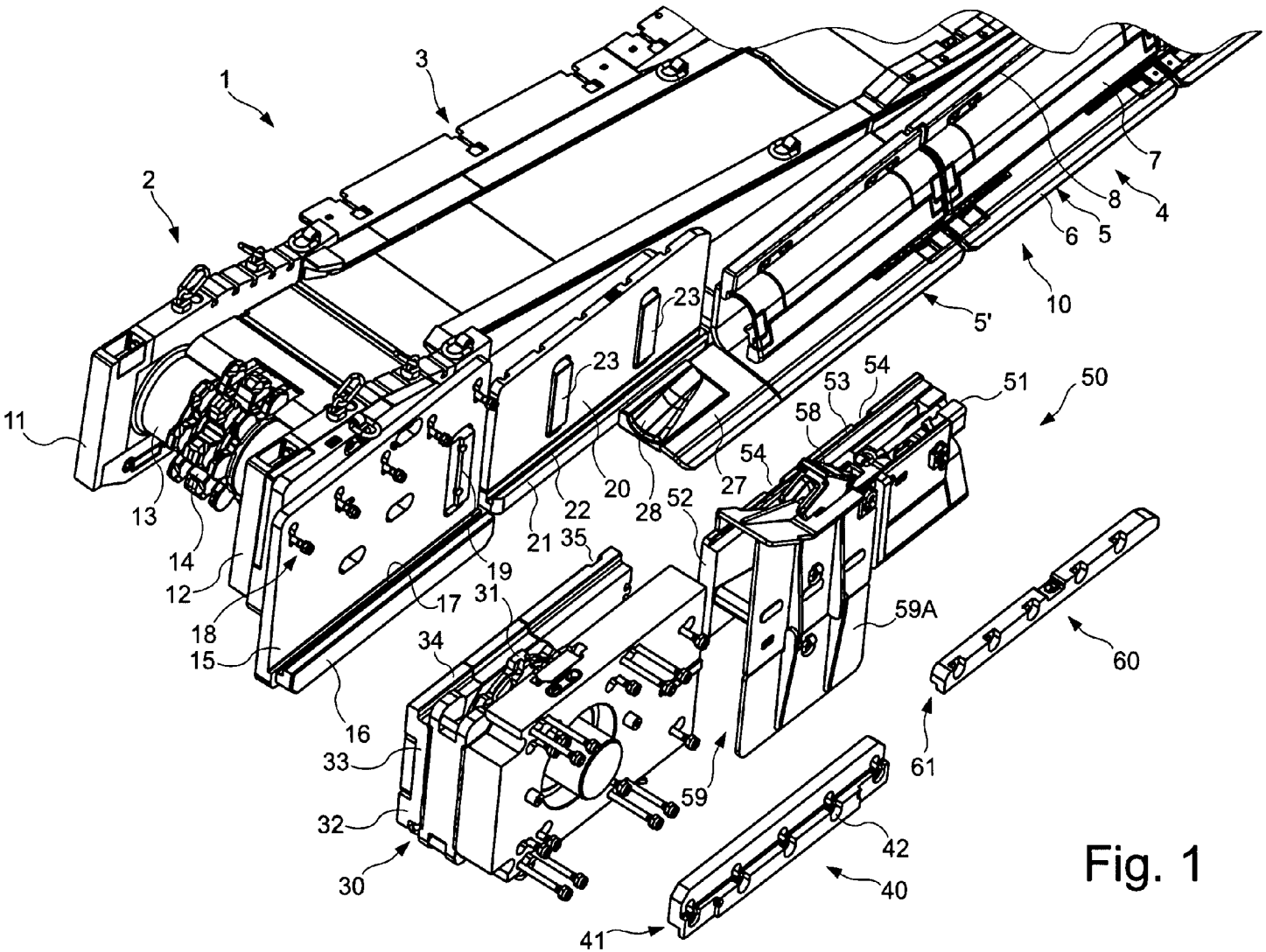
FIG. 1 is a perspective, exploded view of a drive station according to the invention with the wedge trough connected and also the plough box and attachment.

Referring now to the drawings wherein the showings are for the purpose of illustrating preferred and alternative embodiments of the invention only and not for the purpose of limiting same, FIG. 1 shows a drive station of an underground plough system 10 for a winning plough (not shown in the figures), in particular a coal plough, is denoted in its entirety by reference numeral 1. In a manner known per se, the plough system 10 comprises at both ends a drive station 1 with a machine frame 2 and also a wedge trough 3 which adjoins the machine frame in the direction of the winning longwall. A large number of trough pans 4, which are constructed so as to be identical to one another and have a plough guide pan 5 which is built-on at the working face side, then adjoin the wedge trough 3 in order to move a plough, which is restrictedly guided on the guide elements of the plough guide pans 5, for the mining of coal through the longwall. The plough system 10 can have a length of from, for example 100 to 500 meters and up to 200 and more identical trough pans 4 with a built-on plough guide pan 5 can accordingly be arranged between two drive stations 1. In the exemplary embodiment shown, the guide elements for guiding the winning plough consist, in particular, of a slideway 6 resting on the footwall, a lower guide strip 7, behind which a chain block, which engages into a lower chain guide channel for a plough chain (not shown), grips, and also an upper guide strip 8 on which the body of the winning plough is guided by means of a plurality of guide shoes. As this is generally known to the person skilled in the art, the trough pans 4, guide pans 5 or the winning plough will not be described any further here.

The machine frame 2 has a packing-side side cheek 11 and a working face-side side cheek 12 which is arranged set apart therefrom, between which side cheeks a chain shaft 13 with a chain wheel 14 is mounted for driving a scraper chain (not shown in greater detail). The scraper chain, which revolves in the trough pans, is used to remove the coal, which is mined at the face using the winning plough, from the longwall and to transfer it to a gallery conveyor. The two strands of the scraper chain run on the chain wheel 14 further apart from each other than in the region of the trough pans 4 and this height offset is compensated for by the wedge shape of the wedge or connection trough 3. FIG. 1 clearly shows that a guide pan 5', which is embodied in an identical manner to the further guide pans 5 of the trough pans 4 laid in the longwall, is fastened to the wedge trough 3. This plough guide pan 5' forms part of a runout section for the winning plough in the region of the drive station 1 or the wedge trough 3, the distance between the guideway for the winning plough and the runway for the scraper chain increasing slightly in the region of the runout section. In the exemplary embodiment shown, the plough guide pan 5' extends over roughly half the length of the connection or wedge trough 3.

A plough box 30 is dismantlably fastened to the working face-side side cheek 12 of the machine frame 2 for supporting a plough chain wheel 31, the plough chain (not shown) being alternately driven by means of the plough chain wheel 31 for moving the winning plough back and forth. A flange plate 15, with a lower, securely mounted and in particular welded-on holding rail 16, is fastened to the working face-side side cheek 12 for detachably fastening the plough box 30. The holding rail 16 forms a lower, upwardly open groove 17 into which the plough box 30 engages with the lower web 32 of a packing-side mounting plate 33 in the mounted state. The mounting plate 33 of the plough box 30 is furthermore provided with an upper web 34 in order to be able to fasten the plough box 30 to the flange plate 15 by means of a separate, dismantlable locking strip 40. The locking strip 40 therefore forms the upper interlocking element for the plough box 30 and has a downwardly projecting web strip 41 which, in the mounted state, clamps the upper web 34 on the mounting plate 33 against the flange plate 15. Five fastening screws 18 are secured in a suitable manner to the flange plate 15 for detachably fastening the locking strip 40. In the mounted state, the shanks of the fastening screws penetrate fastening bores 42 in the locking strip 40 in order to fix the locking strip 40 to the flange plate 15 by means of robust screw nuts which can be screwed onto the shanks. A projecting locking body 19, which engages, in the mounted state, into a vertically extending groove recess 35 at the back of the mounting plate 30, is formed on the flange plate 15 for preventing displacement of the plough box 30 in the running direction of the winning plough. The screw connections 18 can as a result be relieved of transverse forces.

The mounting plate 15 extends substantially only over the length of the machine frame 2. A holding plate 20, via which an attachment, which is denoted in its entirety by 50 and comprises a plough end stop 51, can be dismantlably fastened to the wedge trough 3, is fastened, in the mounting state, to the wedge trough 3 between the flange plate 15 and the plough guide pan 5' which may be securely built-on in the front region of the wedge trough 3. For dismantlably fastening the attachment 50, the flange plate 20 is, like the holding plate 15, provided at the bottom with an in this case U-shaped guide rail 21 as the lower, hook-like interlocking element. In the mounted state, a packing-side, relatively robustly formed base plate 52 of the attachment 50 engages at its lower end into the groove 22 of the guide rail 21. The base plate 52 of the attachment 50 is arrested at the holding plate 20 by means of a second locking strip 60 which, like the locking strip 40, can be detachably screwed onto the holding plate 20 and held there by means of five fastening screws (not shown). For fixing the attachment 50, the locking strip 60 is provided with a lower web projection 61 which grips behind a web strip 53 at the upper end of the base plate 52 and clamps the web strip 53 against the holding plate 20. Two vertically extending, open-edged recesses 54, which interact, when the attachment 50 is mounted on the holding plate 20 of the wedge trough 3, with two locking bodies 23 which are designed as vertical strips and project beyond the surface of the holding plate, are formed here at the back of the base plate 52. The locking bodies 23, which engage into the recesses 54, cause form-fitting anchoring of the attachment 50 in the running direction of the winning plough and relieve the screw connections for arresting the locking strip 60 when the winning plough strikes, in plough mode, the plough end stop 51. The attachment 50 with the integrally formed plough end stop 51 can be detached from the wedge trough 3 even when not only is the plough guide pan 5 mounted on the wedge trough 3, but also the plough box 30 remains in its mounted position. The configuration can however also be designed in such a manner that both the plough box 30 and the attachment 50 can be dismantled or must be jointly dismantled in order to remove the plough end stop 51 from the runout section for the winning plough.

Figure 2:
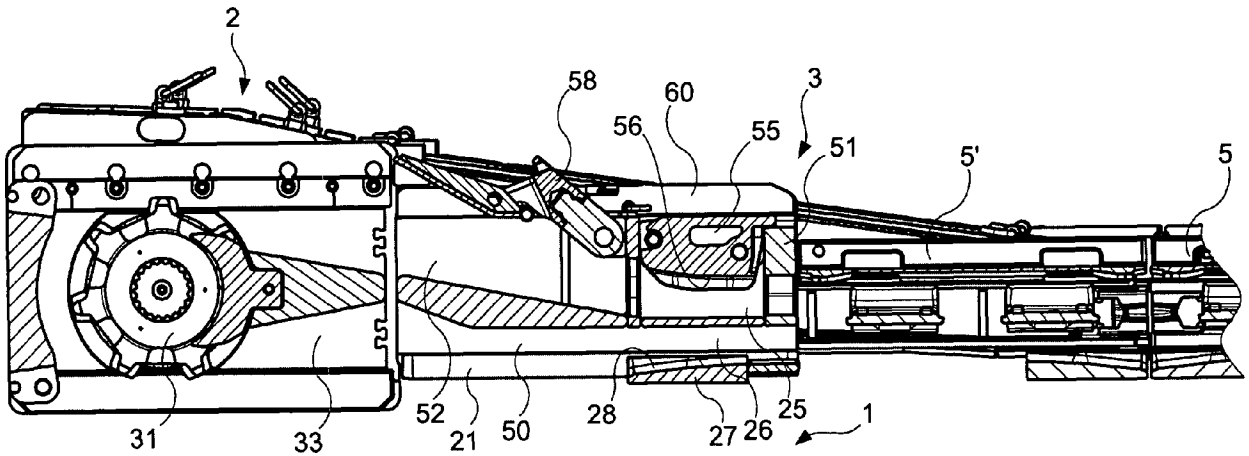
FIG. 2 shows the drive station from FIG. 1 with the plough box and attachment mounted and partly broken-open.

FIG. 2 shows particularly clearly that the distance between the upper plough chain channel 25 and the lower plough chain channel 26 for the plough chain increases between the plough guide pan 5', which is securely mounted on the wedge trough 3, and the plough chain wheel 31. In order to achieve a course of the plough chain that is as uniform and defined as possible in the upper chain guide channel 25, a sliding piece 55, which is in the form of a wearing piece and can relatively easily be replaced by a new sliding piece 55, is fastened to the plough end stop 51 of the attachment 50, directly behind it. The upper strand of the plough chain is deflected with the underside 56 of the sliding piece 55 from its horizontal course in the longwall into an oblique course in relation to the plough chain wheel 31. A run-in piece 27 for the lower chain channel 26 is positioned below the sliding piece 55. The run-in piece 27, which is in this case welded onto the guide rail 21 at the working-face side, has at its upper side a run-in bevel 28, which is designed with wear protection, for guiding the lower strand of the plough chain.

Furthermore, a pivotable blocking pawl 58, as the fixing device for the upper strand of the plough chain, is arranged between the sliding piece 55 and the plough chain wheel 31, wherein this blocking pawl 58 can be pivoted downward into the upper chain channel 25, as a result of which the plough chain is arrested. In order subsequently to be able to incorporate or remove chain links between the plough chain wheel 31 and the blocking pawl 58, the chain channel cover 59 (FIG. 1) is dismantlable at least in the region of the blocking pawl 58. In the exemplary embodiment shown, the chain channel cover 59 for the lower chain channel 26 is provided with a foldable end flap 59A.

When the attachment 50 is dismantled, a winning plough can be moved beyond the plough guide pan 5', which is securely mounted on the wedge trough 3, further in the direction of the machine frame 2. It might be sufficient to remove just the attachment 50 with the plough end stop 51 in order to be able to carry out some of the necessary repair work on the winning plough in a winning section. As the repair section, which is lengthened or laid, in accordance with the invention, into the rear, drive-side region of the wedge trough 3, is located in the longwall-gallery transition, it allows staff to move much more freely. In addition, it is at the same time situated closer to the gallery and thus closer to a material replacement store.

Figure 3:
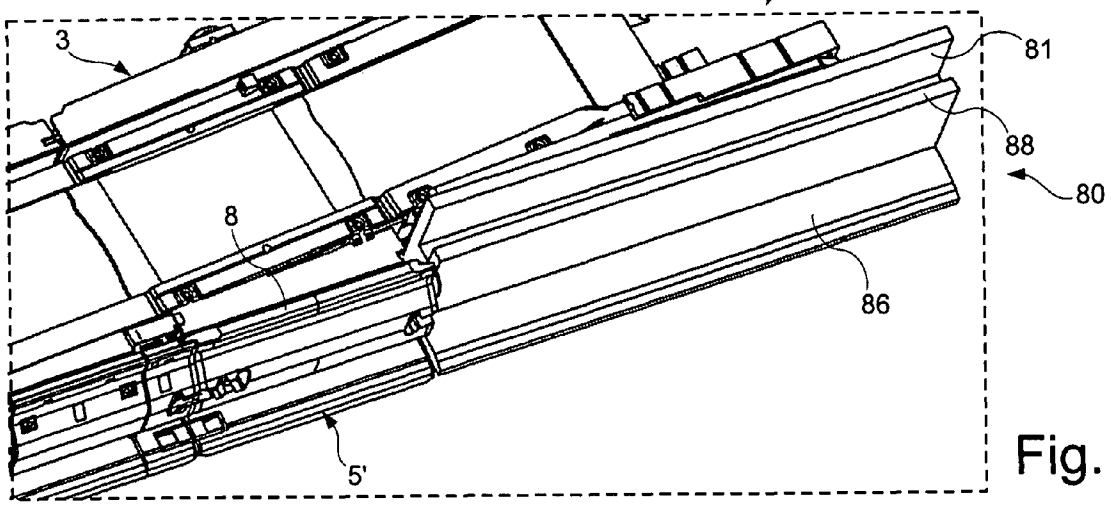
FIG. 3 shows by way of example a drive station according to the invention with the running rail mounted.

FIG. 3 illustrates a particularly advantageous configuration facilitated by the invention of a drive station 1 according to the invention. Of the drive station 1, FIG. 3 shows substantially only the working face-side side walls 12 of the machine frame 2. The chain edge and also the further parts of the machine frame 2 of the drive station 1 are not shown. The wedge trough 3 is also shown merely schematically with the working face-side plough guide pan 5' which is preferably securely mounted. As both the attachment and the plough box has been removed, it is possible for there to be mounted at their position a running rail 80 which lengthens the repair section here beyond the machine frame 2 of the drive station into the underground section. The running rail 80 can be arrested preferably via the same screw holes as the locking strips (40, 60) for the attachment and the locking box, and the guide rail 80 has preferably a rear fastening lath 81 which engages with its lower end into the grooves on the guide strips of the flange plate and also the holding plate. The guide rail 80 is furthermore provided, in the same position as the plough guide pan 5', with a lower slideway 86 and at least with an upper guide strip 88 which lengthens the guide strip 8 on the plough guide pan 5'.

The invention is not limited to the illustrated exemplary embodiment and the foregoing description will suggest to the person skilled in the art numerous modifications which are intended to be included in the scope of protection of the appended claims. The repair section can optionally be lengthened by means of a running rail. The running rail could also extend only over the region of the wedge trough or be dispensed with. The further the repair section, with or if appropriate else without the running rail, is laid into the gallery or the longwall-gallery transition, the safer miners who have to carry out repair work or maintenance work will also be. The locking bodies could also be formed on the attachment and the recesses be formed accordingly on the wedge trough or the base plate. Furthermore, it will be apparent to the person skilled in the art that the repair method according to the invention can also be altered in various ways as, for the repair method, it is above all advantageous to be able to dismantle the plough end stop in order to move the plough in a relatively simple manner out of the longwall. It goes without saying that this may require the plough chain to be severed. The embodiment of the plough end stop may vary from winning plough to winning plough and it may if appropriate also be in the form of a detachable and/or spring-mounted impact chock. The guide rails and also locking strips for supporting and arresting the attachment and the plough box can extend in one piece over the entire length of the flange plate or holding plate or, as a plurality of partial pieces, each only over a partial length.

Further, while considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

The invention claimed is:

1. A drive station for an underground plough system, in particular a coal plough system, the drive station comprising a machine frame and a plough box for supporting a plough chain wheel for deflecting an associated plough chain, the plow box being fastenable to the machine frame, the drive station further including a trough that is connectable to the machine frame and includes a plough guide device which has chain channels for the associated plough chain, the drive station further including an attachment having a plough end stop on a runout section for an associated winning plough, the attachment being removably attached to the trough while the plough guide device remains mounted thereby forming a repair section in the longwall-gallery transition.

2. The drive station as claimed in claim 1, wherein the attachment has a base plate which is fastenable to the trough by hook-like interlocking elements.

3. The drive station as claimed in claim 2, wherein the trough has a holding plate with lower hook-like interlocking elements for arresting the attachment.

4. The drive station as claimed in claim 1, wherein the trough has a holding plate with lower hook-like interlocking elements for arresting the attachment.

5. The drive station as claimed in claim 4, further including a dismantlable locking strip, the locking strip including an upper hook-like interlocking element, the locking strip being detachably attachable to the holding plate to further secure the attachment to the holding plate.

6. The drive station as claimed in claim 1, wherein the plough guide device includes a plough guide pan which is securely mounted on the trough.

7. The drive station as claimed in claim 3, wherein the holding plate includes at least one projecting locking body extending outwardly from the holding plate, and the base plate including at least one recess, the at least one recess being configured to interact with a corresponding locking body to provide form-fitting support of the attachment in the running direction of the associated winning plough.

8. The drive station as claimed in claim 7, wherein the at least one recess in the base plate includes vertically extending, open-edged slots allowing upward dismantling of the attachment from the holding plate.

9. The drive station as claimed in claim 1, wherein the attachment includes a chain fixing device.

10. The drive station as claimed in claim 9, wherein the chain fixing device is formed by a pivotable blocking pawl.

11. The drive station as claimed in claim 2, wherein the attachment includes a chain fixing device, the attachment further including a chain channel cover which is opposite of the base plate, the chain channel cover being at least partially removable to allow access to the chain fixing device.

12. The drive station as claimed in claim 1, further including a flange plate secured relative to the machine frame, the flange plate including lower hook-like interlocking elements to at least partially support the plough box, the drive station further including a locking strip having an upper hook-like interlocking element, the locking strip being detachably attachable to the flange plate to further secure the plow box to the flange plate.

13. The drive station as claimed in claims 1, wherein the trough further includes a running rail to lengthen the repair section when the attachment is dismantled.

14. The drive station as claimed in claim 3, wherein the trough further includes a running rail to lengthen the repair section when the attachment is dismantled, the running rail extending along the holding plate for the attachment and along the machine frame in order to further lengthen the repair section into the underground section.

15. A method for carrying out repair work on a winning plough wherein the winning plow is movable in an underground longwall between two working stations of a plough system, the method including the steps of providing a drive station having a machine frame, to which a plough box is fastened for supporting a plough chain wheel for deflecting a plough chain, providing a trough which is connected to the machine frame and includes a plough guide device which is arranged on a runout section for the winning plough, the method further including the steps of providing a plough end stop and forming a repair section in at least one of a longwall-gallery transition and in a gallery area by dismantling the plough end stop and moving the winning plough into the repair section for the repair work.

16. The method as claimed in claim 15, further including the steps of providing a running rail and fastening the running rail to the trough for producing a repair section, when the plough box is dismantled.

17. The method as claimed in claim 16, wherein the running rail extends along the machine frame when the plough box is dismantled.

18. The method as claimed in claims 15, wherein the trough is a wedge trough.

19. The method as claimed in claims 15, wherein the trough is a connection trough.

20. The drive station as claimed in claims 1, wherein the trough is a wedge trough.

21. The drive station as claimed in claims 1, wherein the trough is a connection trough.

* * * * *